United States Patent [19]

Koichi

[11] 4,087,960

[45] May 9, 1978

[54] SOLAR BATTERY WRISTWATCH

[75] Inventor: Oguchi Koichi, Suwa, Japan

[73] Assignee: Kabushiki Kaisha Suwa Seikosha, Tokyo, Japan

[21] Appl. No.: 692,070

[22] Filed: Jun. 2, 1976

[30] Foreign Application Priority Data

Jun. 2, 1975 Japan ..... 50-66151

[51] Int. Cl.[2] ..... G04C 3/00; G04B 19/06

[52] U.S. Cl. ..... 58/127 R; 58/23 BA; 58/23 C

[58] Field of Search ..... 58/23 R, 23 BA, 23 C, 58/55, 127 R; 136/89 AC, 89 TF; 361/398

[56] References Cited

U.S. PATENT DOCUMENTS

| | | | |
|---|---|---|---|
| 2,962,539 | 11/1960 | Daniel | 136/89 TF |
| 3,433,677 | 3/1969 | Robinson | 136/89 TF |
| 3,757,511 | 9/1973 | Burgess et al. | 58/127 R |
| 3,968,640 | 7/1976 | Clemmer | 58/23 R |

FOREIGN PATENT DOCUMENTS

| | | | |
|---|---|---|---|
| 1,119,215 | 6/1956 | France | 58/23 C |

*Primary Examiner*—Edith S. Jackmon

*Attorney, Agent, or Firm*—Blum, Moscovitz, Friedman & Kaplan

[57] ABSTRACT

A solar-battery wristwatch makes use of a flexible printed-circuit board for connecting the cells of the battery in series and for connecting said battery with a storage battery. The arrangement eliminates the need for connecting wires and extraneous supports in that the flexible printed-circuit board holds the solar battery against the dial plate of the watch.

8 Claims, 6 Drawing Figures

SOLAR BATTERY WRISTWATCH

BACKGROUND OF THE INVENTION

The wristwatch market at the present time is moving strongly in the direction of the battery-powered type which uses a quartz crystal oscillator as a time-standard. The accuracy of such watches is far superior to the accuracy of watches depending upon the mechanical movement of one type or another. The driving energy of such wristwatches is supplied by an electro-chemical cell or a battery, depending upon the voltage necessary to drive both the circuitry and the display means.

In order to avoid the need for changing the battery or cell with a frequency sufficiently great as to make such wristwatches appear unreliable and bothersome, a silver oxide battery is generally used because such batteries provide a maximum in stored energy. However, since it is desired to make such watches as small as possible, particularly where the watch is to be worn by a woman, the capacity of the battery must similarly be restricted. Consequently it has not been possible to design such watches to accept a battery which will provide the necessary power for longer than a period of a year or two. This problem has been met by incorporating a solar battery in the wristwatch for recharging the electro-chemical battery, it obviously being necessary to use a rechargeable, i.e., a storage battery rather than a primary, the latter being the type used in the absence of a solar battery.

Although the incorporation of a solar battery has eliminated the necessity for periodic replacement of the electro-chemical battery, the full benefit of the solar battery has not as yet been made available, due to the fact that the support structures and connecting portions of the circuitry have been relatively primitive. As is evident, it would be highly desirable to make available designs which minimize space requirements and which, at the same time, provide complete reliability with respect to electrical connection. In addition, the design should be suitable for mass production at as low a cost as possible.

SUMMARY OF THE INVENTION

Solar cells are mounted on a flexible printed-circuit board of a polymer which is preferably highly thermostable. The printed-circuit board has electrical leads thereon disposed for connecting said solar cells into a solar battery, a solar battery providing the necessary high voltage for charging a storage battery.

The printed-circuit board may be fastened to the dial plate of the wristwatch so that the cells are either on the exterior or the interior surface of the printed-circuit board, the exterior surface being that exposed to the light.

Preferably, the ends of the solar cells are encased in a plastic such as an epoxy resin which may also be used to fasten the circuit board against the dial plate. The printed-circuit board is flexible so that it may be bent around to make contact with the storage battery. It may also, simultaneously, serve as a support.

Accordingly, an object of the present invention is a wristwatch including a solar cell battery and a storage battery which is appropriate for manufacture on a mass scale at low cost.

Another object of the present invention is a wristwatch including a solar battery and a storage battery wherein connection between said solar cells is made by means of a flexible printed-circuit board.

A further object of the present invention is a wristwatch including a solar battery and a storage battery in which solar cells are mounted flush with a flexible printed-circuit board and the printed-circuit board is mounted flush with a dial plate.

An important object of the present invention is a wristwatch powered by a combination of a solar battery and a storage battery having high reliability and which can operate for long periods of time without replacement of the storage battery.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
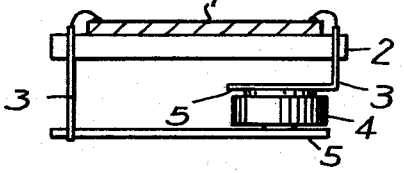
FIG. 1 PRIOR ART
FIG. 1 shows schematically a dial plate, a solar battery and a storage battery mounted and connected in accordance with the prior art.

In FIG. 1 which represents a structure in accordance with the prior art, silicon solar battery 1 is mounted on dial disc 2, the assembly being held above battery 4 and printed-circuit board 5 by supports 3. Electrical connection is made by means of printed circuit board 5.

As can be seen from FIG. 1, the connecting circuitry for joining the solar cell battery to the storage battery is relatively complex. Specifically, after the solar cells are fastened to the dial disc 2, the solar cell battery must be connected to support 3 by means of wire bonding and then to storage battery 4 through printed-circuit board 5. The presence of the support 3 in the conventional method of mounting makes it difficult to miniaturize the wristwatch, and, moreover, the reliability of the entire structure is low because the number of components is greater than necessary.

Figure 2A:
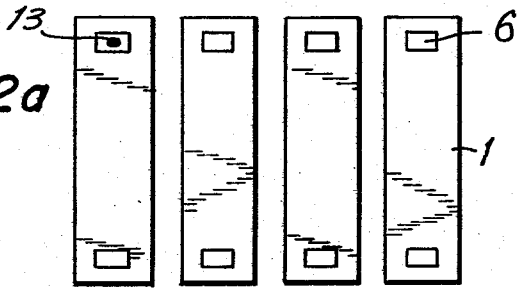
FIG. 2*a* is a group of solar cells.

The present invention solves the problems associated with the conventional structure by a means which will become evident from FIGS. 2*a* through FIGS. 2*e*. FIG. 2*a* shows four solar cells in a side-by-side configuration, each of the solar cells having two electrode portions 6. Conveniently, a bump 13 of gold or of solder is formed by conventional means on each of the electrode portions 6, it being desirable that the bump 13 should protrude very slightly above the adjoining surface of the solar cell 1. This bump will serve to make contact to conductive leads on the printed circuit board on which it will subsequently be mounted. The preferred type of solar cell is the silicon solar cell, but the structure presented herein is suitable for use with any type of solar cell.

Figure 2B:
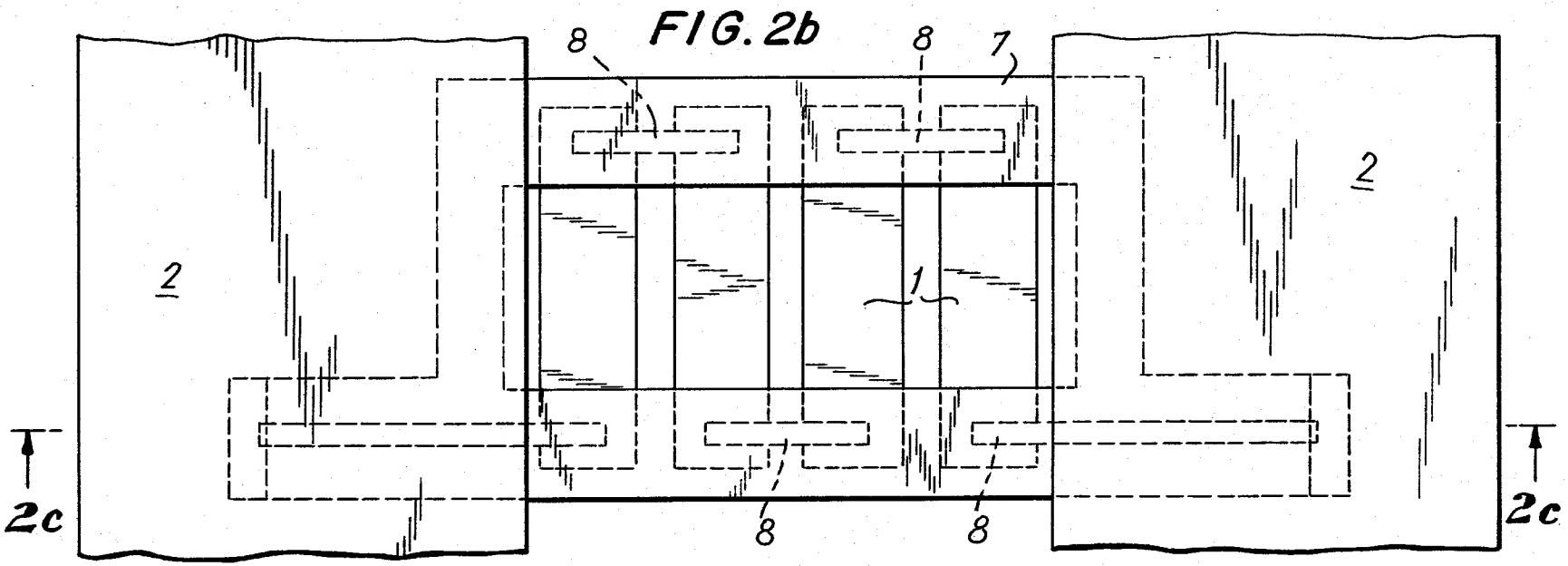
FIG. 2*b* shows a circuit board with solar cells mounted on the interior surface thereof.
Figure 2C:
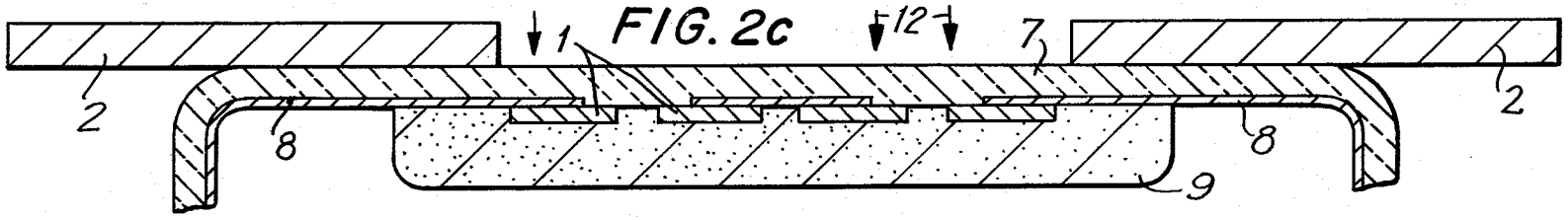
FIG. 2*c* is a view along line 2*c* — 2*c* of FIG. 2*b*, also including resin for bonding the ends of the solar cells to a printed-circuit board and for bonding the printed-circuit board to a dial plate.

FIG. 2*b* shows portions of a dial plate or dial disc 2 to the undersurface of which is attached flexible printed-circuit board 7. The circuit board is preferably made of a thermostable high polymer, a preferred high polymer being a polyimide. Printed-circuit board 7 is printed with conductive leads or strips 8 positioned for making contact with electrode portions 6 of the solar cells. In the embodiment shown in FIG. 2*b*, the solar cells are mounted to the under or interior surface of printed-circuit board 7. The shape of circuit board 7 is such that the major portion of each of the solar cells 1 is exposed to light as indicated by arrows 12 in FIG. 2*c*. In the arrangement of FIG. 2*b*, the conductive strips 8 are so positioned that the four solar cells are in series, the objective being to increase the voltage provided by the device.

Printed-circuit board 7 may be fastened to dial plate 2 by means of cement, a strap, or any other convenient means. The cells 1 may similarly be joined to the circuit board 7. However, a preferred method is to cast a resin such as curable silicone or epoxy as indicated by the reference numeral 9 in FIG. 2*c* over the ends of solar cells 1 in order to bond the solar cells 1 to the printed circuit board 7, and simultaneously to bond printed circuit board 7 to the underside of the dial plate 2.

Figure 2D:
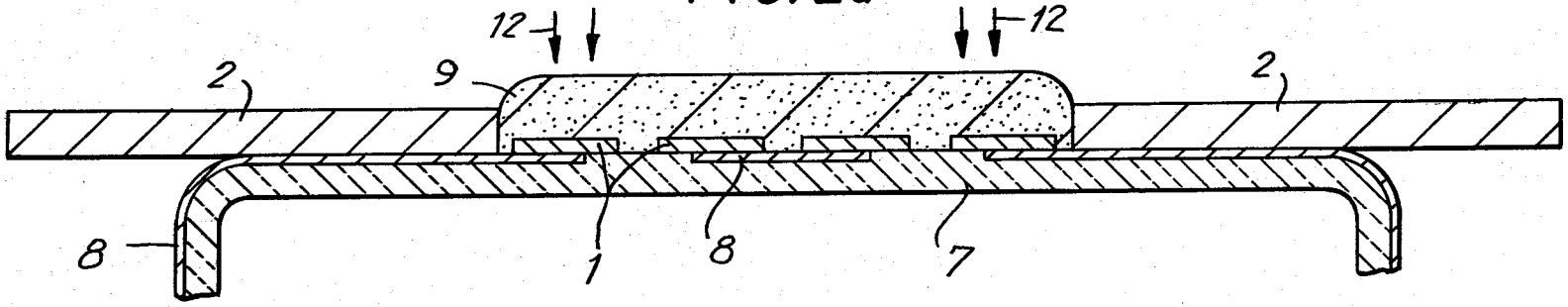
FIG. 2*d* is a view showing solar cells mounted on the exterior surface of a printed-circuit board.

The solar cells, alternatively, may be bonded to the upper or exterior surface of printed-circuit board 7 for exposure to light as indicated by arrows 12. Again, the bonding may be effected by means of a cast or molded resin 9 disposed about the ends of said solar cells as shown in FIG. 2*d*.

Figure 2E:
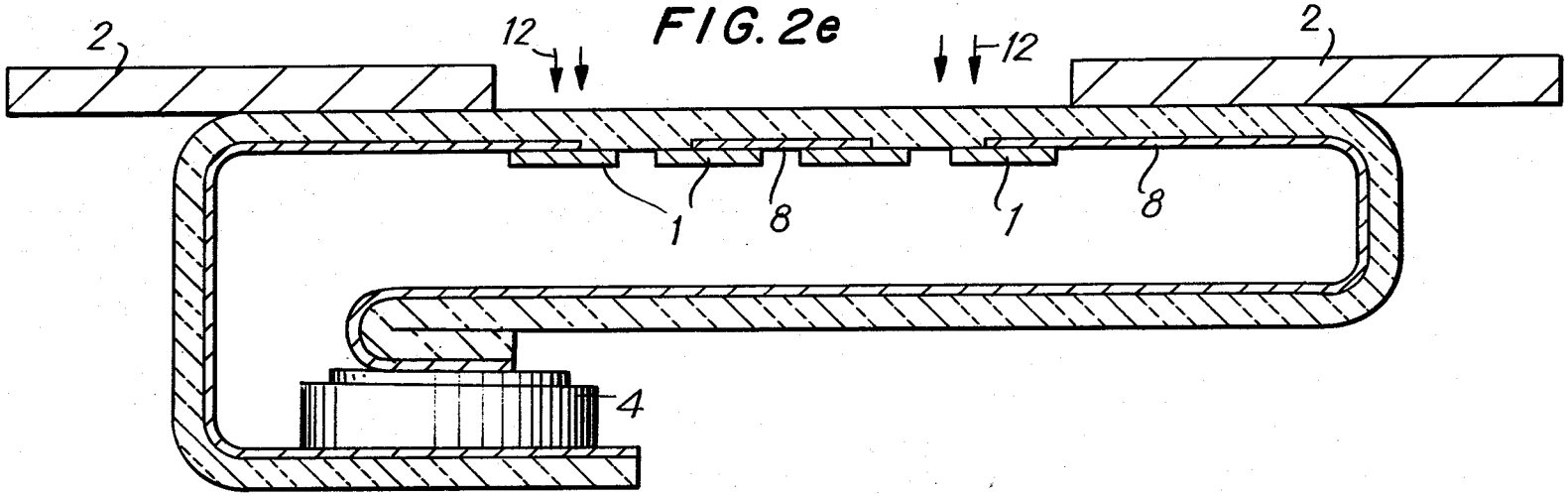
FIG. 2*e* shows the electrical connection between a solar battery and a storage battery.

The manner in which connection to a storage battery is effected is shown in FIG. 2*e*, which illustrates how advantage may be taken of the fact that the printed-circuit board is flexible so that it may be bent to make contact with both terminals of storage battery 4. For clarity, resin 9 is not shown in FIG. 2*e*. As is evident, the arrangement for making contact would be essentially the same if the cells were positioned on the exterior surface of the printed-circuit board.

The advantages obtained by the structure of the present invention can be summarized as follows:

1. The dial disc itself undergoes no process steps, due to the fact that all processing is carried out on the flexible printed-circuit board prior to bonding the same to the dial disc. As a result, delicate colors or other decorations on the surface of dial plate 2 need not be subjected to high temperature or acid vapor.

2. Both manufacturing problems and cost of manufacture are decreased because the flexible printed-circuit board can be formed in a manner similar to that by which tape is formed and so can be made in a continuous strip.

3. A wristwatch constructed as disclosed herein can be miniaturized because the flexible tape or circuit board is used for connecting the silicon solar cells to each other and the resultant battery to the storage battery so that the portion of the wristwatch volume occupied by connecting means is extremely small.

4. Although not shown or discussed herein, the flexible printed-circuit board makes it possible to connect not only the solar battery to the storage battery but also to connect other electronic components such as IC, quartz crystal oscillator, capacitor, resistor, etc., and thereby simplify the task of assembling and connecting the various components of the circuitry involved in driving the wristwatch and operating the display device.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings, shall be interpreted as illustrative and not in a limiting sense.

It is also to be understood that the following claims are intended to cover all of the generic and specific features of the invention herein described, and all statements of the scope of the invention, as a matter of language, might be said to fall therebetween.

What is claimed is:

1. In a solar battery wristwatch including a solar battery, a dial plate, an electronic circuit and storage battery for storing energy generated by said solar battery, the improvement comprising a flexible printed-circuit assembly mounted on said dial plate, said assembly being in the form of a thin tape-shaped strip of electrically-insulating material, said strip having two ends, and including electrically-conductive leads for making electrical contacts among said solar battery, dial plate, electronic circuit and storage battery, at least one cell in said solar battery being bonded by a lead in said strip, said strip being mounted on said dial plate of said wristwatch, both ends of said strip being connected with said electronic circuit said dial plate and printed-circuit assembly being free of openings for transit of electrically-conductive leads therethrough.

2. The improvement as defined in claim 1, wherein said solar battery is fastened to the exterior surface of said printed-circuit board.

3. The improvement as defined in claim 1, wherein said solar battery is fastened to the interior surface of said printed-circuit board.

4. The improvement as defined in claim 1, wherein said flexible circuit board is so disposed that said solar cell battery is connected to said storage battery for charging same.

5. The improvement as defined in claim 1, wherein said solar battery is of silicon.

6. The improvement as defined in claim 1, wherein the cells in said solar battery have end portions and said end portions are encased in a resin disposed for fastening said solar battery to said circuit board.

7. The improvement as defined in 6, wherein said end portions have electrode portions, and each of said end portions has thereon a material selected from the group consisting of gold and solder for making electrical contact between said electrode portions and said electrically-conductive leads.

8. The improvement as defined in claim 1, wherein said printed circuit board is of a polyimide.

* * * * *